US008084927B2

(12) United States Patent
Xiao et al.

(10) Patent No.: US 8,084,927 B2
(45) Date of Patent: Dec. 27, 2011

(54) THERMAL ELECTRON EMITTER AND THERMAL ELECTRON EMISSION DEVICE USING THE SAME

(75) Inventors: Lin Xiao, Beijing (CN); Liang Liu, Beijing (CN); Chang-Hong Liu, Beijing (CN); Shou-Shan Fan, Beijing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 285 days.

(21) Appl. No.: 12/381,620

(22) Filed: Mar. 12, 2009

(65) Prior Publication Data

US 2009/0256135 A1 Oct. 15, 2009

(30) Foreign Application Priority Data

Apr. 11, 2008 (CN) ..... 2008 1 0066573

(51) Int. Cl.
*H01J 1/05* (2006.01)
*H01J 1/02* (2006.01)

(52) U.S. Cl. ..... 313/310; 313/311; 445/50; 445/51; 423/447.1; 423/447.3

(58) Field of Classification Search ..... 313/310, 313/311; 445/50
See application file for complete search history.

(56) References Cited

U.S. PATENT DOCUMENTS

| | | | | |
|---|---|---|---|---|
| 4,249,105 | A * | 2/1981 | Kamegaya et al. | 313/585 |
| 5,967,873 | A | 10/1999 | Rabinowitz | |
| 2003/0036332 | A1 | 2/2003 | Talin et al. | |
| 2003/0090190 | A1 | 5/2003 | Takai et al. | |
| 2004/0102044 | A1 | 5/2004 | Mao et al. | |
| 2005/0127814 | A1 | 6/2005 | Deguchi et al. | |
| 2006/0022568 | A1 * | 2/2006 | Kornilovich et al. | 313/271 |
| 2006/0091782 | A1 * | 5/2006 | Liu et al. | 313/496 |
| 2007/0296323 | A1 * | 12/2007 | Liu et al. | 313/311 |
| 2008/0170982 | A1 | 7/2008 | Zhang et al. | |
| 2009/0160306 | A1 | 6/2009 | Xiao et al. | |

FOREIGN PATENT DOCUMENTS

CN 101465254 6/2009

* cited by examiner

*Primary Examiner* — Sikha Roy
(74) *Attorney, Agent, or Firm* — Altis Law Group, Inc.

(57) ABSTRACT

A thermal electron emitter includes at least one carbon nanotube twisted wire and a plurality of electron emission particles mixed with the twisted wire. The carbon nanotube twisted wire comprises a plurality of carbon nanotubes. A work function of the electron emission particles is lower than the work function of the carbon nanotubes. A thermal electron emission device using the thermal electron emitter is also related.

19 Claims, 4 Drawing Sheets

THERMAL ELECTRON EMITTER AND THERMAL ELECTRON EMISSION DEVICE USING THE SAME

RELATED APPLICATIONS

This application is related to commonly-assigned, co-pending applications: U.S. patent application Ser. No. 12/006,305, entitled "METHOD FOR MANUFACTURING FIELD EMISSION ELECTRON SOURCE HAVING CARBON NANOTUBES", filed on 2007 Dec. 29; U.S. patent application Ser. No. 12/080,604, entitled "THERMAL ELECTRON EMISSION SOURCE HAVING CARBON NANOTUBES AND METHOD FOR MAKING THE SAME", filed 2008 Apr. 4; and U.S. patent application Ser. No. 12/381,576, entitled "METHOD FOR MAKING THERMAL ELECTRON EMITTER", filed on 2009 Mar. 12. The disclosure of the above-identified applications are incorporated herein by reference.

BACKGROUND

1. Technical Field

The present disclosure relates to electron emitters and, more particularly, to a thermal electron emitter based on carbon nanotubes.

2. Discussion of Related Art

Thermal electron emission devices are widely applied in gas lasers, arc-welders, plasma-cutters, electron microscopes, x-ray generators, and the like. Conventional thermal electron emission devices are constructed by forming an electron emissive layer made of alkaline earth metal oxide on a base. The alkaline earth metal oxide includes BaO, SrO, CaO, or a mixture thereof. The base is made of an alloy including at least one of Ni, Mg, W, Al and the like. When thermal electron emission devices are heated to a temperature of about 800° C., electrons are emitted from the thermal electron emission source. Since the electron emissive layer is formed on the surface of the base, an interface layer is formed between the base and the electron emissive layer. Therefore, the electron emissive alkaline earth metal oxide is easy to split off from the base. Further, thermal electron emission devices are less stable because alkaline earth metal oxide is easy to vaporize at high temperatures. Consequently, the lifespan of the electron emission device tends to be low.

What is needed, therefore, is a thermal electron emission device, which has stable and high electron emission efficiency, as well as a great mechanical durability.

BRIEF DESCRIPTION OF THE DRAWINGS

Many aspects of the present thermal electron emitter and thermal electron emission device using the same can be better understood with references to the following drawings. The components in the drawings are not necessarily drawn to scale, the emphasis instead being placed upon clearly illustrating the principles of the present thermal electron emitter and thermal electron emission device using the same.

Figure 1:
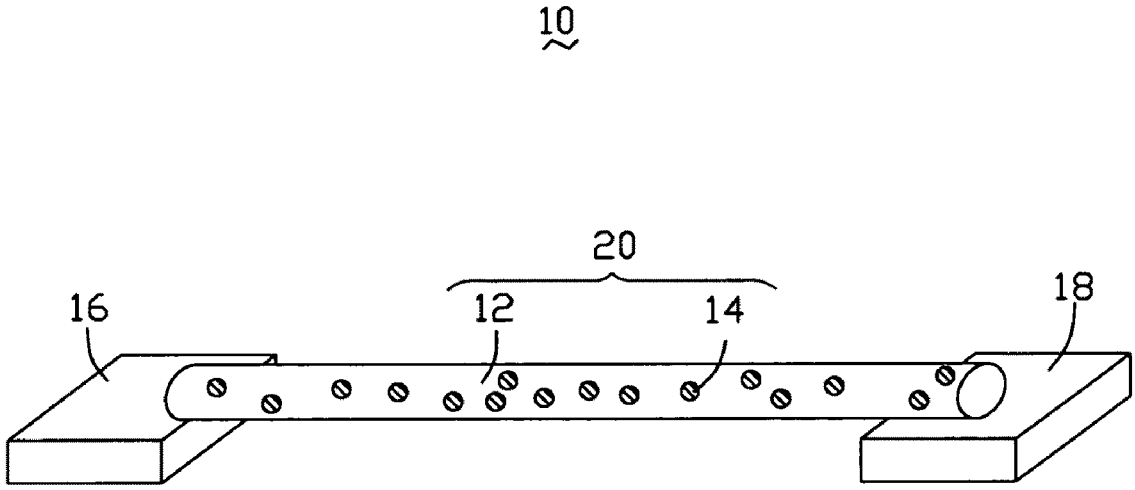
FIG. 1 is a schematic view of a thermal electron emission device, in accordance with a present embodiment.

Corresponding reference characters indicate corresponding parts throughout the several views. The exemplifications set out herein illustrate at least one embodiment of the present thermal electron emission device, in at least one form, and such exemplifications are not to be construed as limiting the scope of the disclosure in any manner.

DETAILED DESCRIPTION

References will now be made to the drawings to describe, in detail, various embodiments of the present thermal electron emission device.

Referring to FIG. 1, a thermal electron emission device 10 includes a thermal electron emitter 20, a first electrode 16, and a second electrode 18. The thermal electron emitter 20 includes a carbon nanotube twisted wire 12 and a number of electron emission particles 14. The twisted wire 12 is configured to serve as a matrix. The electron emission particles 14 are uniformly dispersed either inside or on surface of the twisted wire 12. Two opposite ends of the twisted wire 12 are electrically connected to the first electrode 16 and the second electrode 18, respectively. In the present embodiment, the twisted wire 12 is contacted to the first electrode 16 and the second electrode 18 with a conductive paste/adhesive, such as a silver paste.

Figure 2:
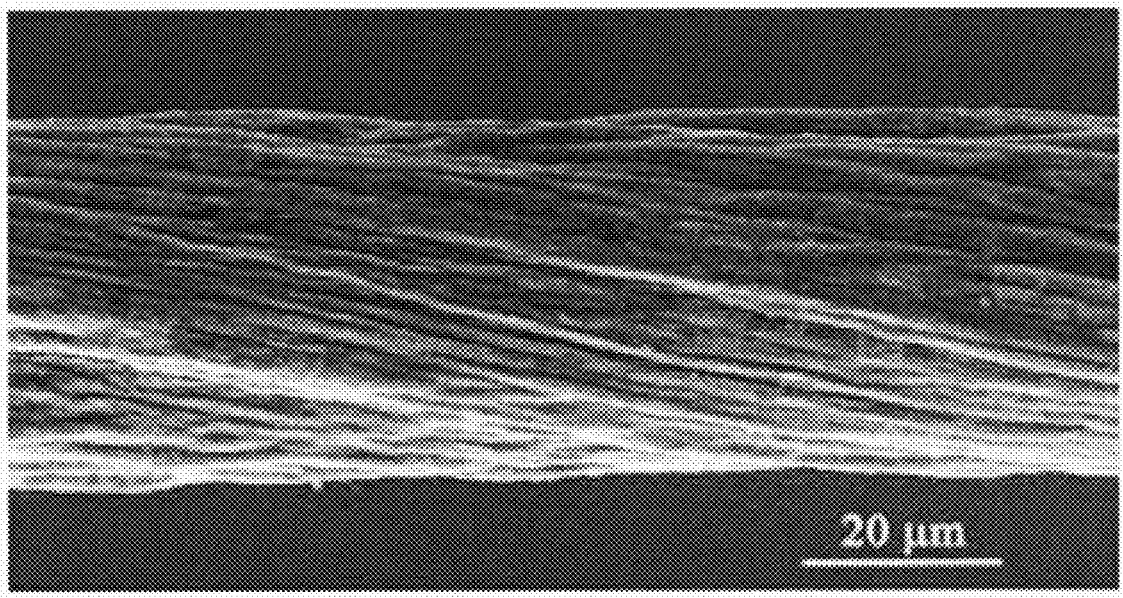
FIG. 2 is a Scanning Electron Microscope (SEM) image of a carbon nanotube twisted wire of the thermal electron emission source, in accordance with the present embodiment.

Referring to FIG. 2, the twisted wire 12 includes a plurality of successively oriented carbon nanotubes. The adjacent carbon nanotubes are entangled with each other. The adjacent carbon nanotubes are joined by van der Waals attractive force. The carbon nanotubes of the twisted wire 12 can be selected from the group consisting of single-walled carbon nanotubes, double-walled carbon nanotubes, multi-walled carbon nanotubes, and combinations thereof. Diameters of the single-walled carbon nanotubes range from 0.5 to 50 nanometers. Diameters of the double-walled carbon nanotubes range from 1 to 50 nanometers. Diameters of the multi-walled carbon nanotubes range from 1.5 to 50 nanometers. A length of the carbon nanotubes is more than 50 micrometers. In the present embodiment, lengths of the carbon nanotubes range from 200 micrometers to 900 micrometers. The electron emission particles 14 are attached to the surfaces of the carbon nanotubes of the twisted wire 12. The twisted wire 12 has a stranded structure, with the carbon nanotubes being twisted by a spinning process. Diameter of the twisted wire 12 is in an approximate range of 20 micrometers (μm) to 1 millimeter (mm). However, length of the twisted wire 12 is arbitrary. In the present embodiment, the length of the twisted wire 12 is in an approximate range from 0.1 to 10 centimeters (cm).

The electron emission particles 14 are made of at least one low work function material selected from the group consisting of alkaline earth metal oxides, alkaline earth metal borides, and mixtures thereof. The alkaline earth metal oxides are selected from the group consisting of barium oxide (BaO), calcium oxide (CaO), strontium oxide (SrO), and mixtures thereof. The alkaline earth metal borides are selected from the group consisting of thorium boride (ThB), yttrium boride (YB), and mixtures thereof. Diameters of the electron emission particles 14 are in a range of 10 nanometers (nm) to 100 μm.

Mass ratio of the electron emission particles 14 to the twisted wire 12 ranges from 50% to 90%. In the present embodiment, at least part of the electron emission particles 14 are dispersed in the twisted wire 12 and on the surface of the carbon nanotubes.

The temperature at which the thermal electron emitter 20 emits electrons depend on the number of the electron emission particles 14 included in the twisted wire 12. The more electron emission particles 14 included in the twisted wire 12, the lower the temperature at which the thermal electron emitter 20 will emit electrons. In the present embodiment, electrons are emitted from the thermal electron emitter 20 at around 800° C.

In some embodiments, the thermal electron emitter 20 may include two or more twisted wires 12, which are then twisted together. Thus, the thermal electron emitter 20 has a larger diameter and high mechanical durability, and can be used in macro-scale electron emission devices.

Figure 4:
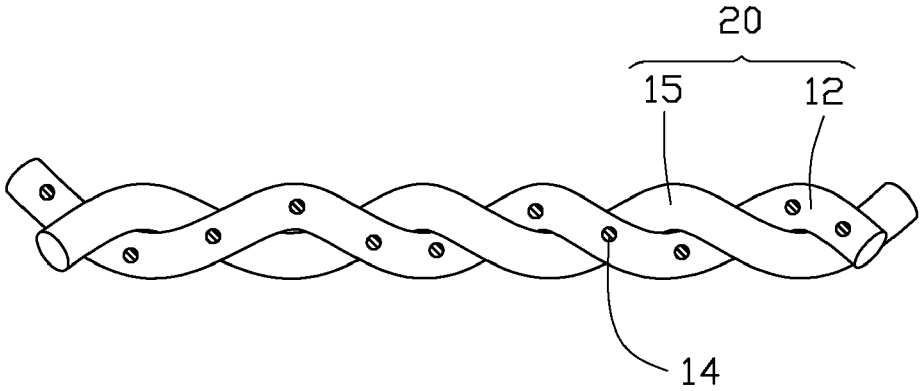
FIG. 4 is a schematic view of one embodiment of a thermal electron emitter.

In other embodiments, the thermal electron emitter 20 may include at least one twisted wire 12 and at least one conductive wire 15, as shown in FIG. 4. The at least one twisted wire 12 and at least one conductive wire 15 are twisted together. Thus, the thermal electron emitter 20 has high mechanical durability and flexibility. The conductive wire 15 can be made of metal or graphite.

The first and second electrodes 16 and 18 are separated and insulated from each other. The first and second electrodes 16 and 18 are made of a conductive material, such as metal, alloy, carbon nanotube or graphite. In the present embodiment, the first and second electrodes 16, 18 are copper sheets electrically connected to an external electrical circuit (not shown).

Compared with conventional thermal electron emission devices, the present thermal electron emission device has the following advantages. Firstly, the included carbon nanotubes are stable at high temperatures in vacuum, thus the thermal electron emission device has stable electron emission characteristics. Secondly, the electron emission particles are uniformly dispersed in the carbon nanotube wire, providing more electron emission particles to emit more thermal electrons. Accordingly, the electron-emission efficiency thereof is improved. Thirdly, the carbon nanotube matrix of the present thermal emission device is mechanically durable, even at relatively high temperatures. Thus, the present thermal emission source can be expected to have a longer lifespan and better mechanical behavior when in use, than previously available thermal emission devices. Fourthly, the carbon nanotubes have large specific surface areas and can adsorb more electron emission particles, thus enabling the thermal electron emission device to emit electrons at lower temperatures.

In operation, a voltage is applied to the first electrode 16 and the second electrode 18, thus current flows through the twisted wire 12. The twisted wire 12 then heats up efficiently according to Joule/resistance heating. The temperature of the electron emission particles 14 rises quickly. When the temperature is about 800° C. or more, electrons are emitted from the electron emission particles 14.

Figure 3:
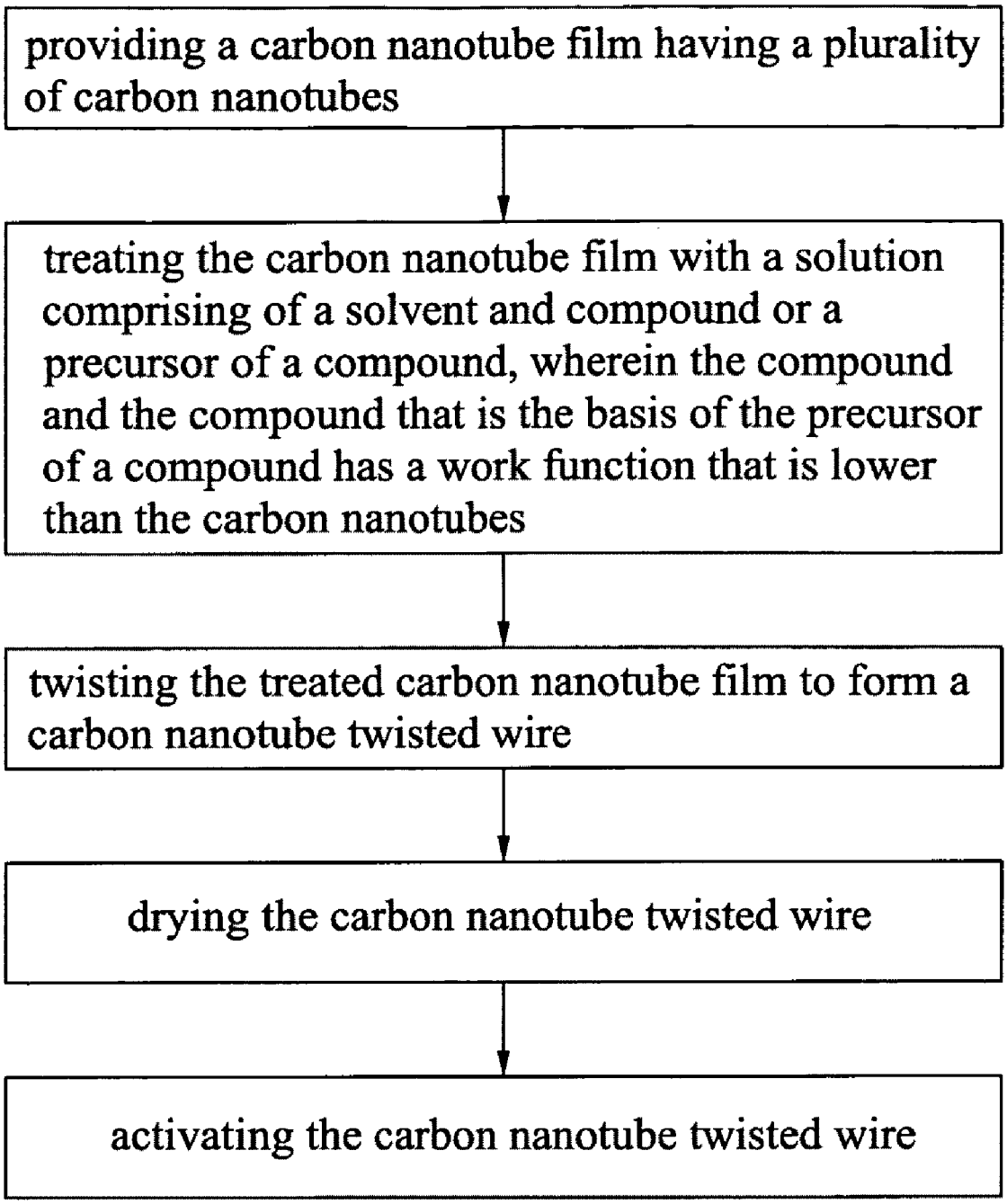
FIG. 3 is a flow chart of a method for making a thermal electron emitter, in accordance with a present embodiment.

Referring to FIG. 3, a method for making the thermal electron emitter 20 includes the following steps of: (a) providing a carbon nanotube film having a plurality of carbon nanotubes; (b) soaking the carbon nanotube film using a solution comprising a compound or a precursor of a compound with work function lower than the carbon nanotubes and a solvent; (c) twisting the treated carbon nanotube film to form a carbon nanotube twisted wire; (d) drying the carbon nanotube twisted wire; and (e) activating the carbon nanotube twisted wire.

In step (b), soaking the carbon nanotube film can be performed by applying the solution to the carbon nanotube film continuously or immersing the carbon nanotube film in the solution for a period of time ranging, e.g. from about 1 second to about 30 seconds. The solution infiltrates the carbon nanotube film.

The compound is selected from a group consisting of alkaline earth metal oxide, alkaline earth metal boride, and a mixture thereof. The precursor of the compound can be an alkaline earth metal salt. The precursor can decompose at high temperatures to form electron emission particles. The alkaline earth metal salt can be selected from the group comprising barium nitrate, strontium nitrate, calcium nitrate and combination thereof. The solvent is volatilizable and can be selected from the group comprising water, ethanol, methanol, acetone, dichloroethane, chloroform, and any appropriate mixture thereof.

In the present embodiment, the alkaline earth metal salt is a mixture of barium nitrate, strontium nitrate, and calcium nitrate with a molar ratio of about 1:1:0.05. The solvent is a mixture of deionized water and ethanol with a volume ratio of about 1:1, and the concentration of barium ion is about 0.1-1 mol/L.

In step (c), the carbon nanotube twisted wire 12 is formed by twisting the treated carbon nanotube film with a mechanical force, and thus the mechanical properties (e.g., strength and toughness) of the carbon nanotube twisted wire 12 can be improved. The process of twisting the treated carbon nanotube film includes the following steps of: (c1) providing a tool to contact and adhere to at least one portion of the treated carbon nanotube film; and (c2) turning the tool at a predetermined speed to twisted the treated carbon nanotube film. The tool can be turned clockwise or anti-clockwise. In the present embodiment, the tool is a spinning machine. After attaching one end of the treated carbon nanotube film on to the spinning machine, turning the spinning machine at a velocity of about 200 revolutions per minute to form the carbon nanotube twisted wire 12. The alkaline earth metal salt is filled in the carbon nanotube twisted wire 12 or dispersed on the surface of the carbon nanotube twisted wire 12 after the treated carbon nanotube film is twisted with a mechanical force.

In step (d), the carbon nanotube twisted wire 12 can be dried in air and at a temperature of about 100 to about 400° C. In the present embodiment, the carbon nanotube twisted wire 12 is dried in air at a temperature of about 100° C. for about 10 minutes to about 2 hours. After volatilizing the solvent, the alkaline earth metal salt particles are deposited on the surface of the carbon nanotubes of the carbon nanotube twisted wire 12. In the other embodiment, the alkaline earth metal salt particles can be dispersed in the carbon nanotube twisted wire 12, dispersed on the surface of the carbon nanotube twisted wire 12 or both. In the present embodiment, the mixture of barium nitrate, strontium nitrate and calcium nitrate are dispersed in the carbon nanotube twisted wire 12 or dispersed on the surface of the carbon nanotube twisted wire 12 in the form of particles.

In step (e), the carbon nanotube twisted wire 12 can be placed into a sealed furnace having a vacuum or inert gas atmosphere therein. In the present embodiment, in a vacuum of about $10^{-2}$-$10^{-6}$ Pascals (Pa), the carbon nanotube twisted wire 12 is supplied with a voltage until the temperature of the carbon nanotube twisted wire reaches about 800 to about 1400° C. Holding the temperature for about 1 to about 60 minutes, the alkaline earth metal salt is decomposed to the alkaline earth metal oxide. After being cooled to the room temperature, the thermally emissive carbon nanotube twisted wire 12 is formed, with the alkaline earth metal oxide particles uniformly dispersed on the surface of the carbon nanotubes thereof. The alkaline earth metal oxide particles thereon are the electron emission particles 14.

In others embodiments, after step (e), at least two twisted wires 12 filled with the electron emission particles 14 can be twisted together. Thus, the thermal electron emitter 20 has a larger diameter, high mechanical durability and can be used in macro electron emission devices.

Alternatively, after step (e), at least one twisted wire 12 filled with the electron emission particles 14 and at least one conductive wire can be twisted together. Thus, the thermal electron emitter 20 has a high mechanical durability and flexibility. The conductive wire can be made of metal or graphite.

Furthermore, the twisted wire 12 is attached to first and second electrodes 16, 18 by a conductive paste/adhesive to form a thermal electron emission device 10. The conductive paste/adhesive can be conductive silver paste. That is, one end of the carbon nanotube twisted wire 12 is attached to the first electrode 16, and the opposite end of the carbon nanotube twisted wire 12 is attached to the second electrode 18.

It is to be understood that the above-described embodiments are intended to illustrate, rather than limit, the invention. Variations may be made to the embodiments without departing from the spirit of the invention as claimed. The above-described embodiments illustrate the scope of the invention but do not restrict the scope of the invention.

It is also to be understood that the above description and the claims drawn to a method may include some indication in reference to certain steps. However, the indication used is only to be viewed for identification purposes and not as a suggestion as to an order for the steps.

What is claimed is:

1. A thermal electron emitter comprising:

at least one carbon nanotube twisted wire comprising a plurality of carbon nanotubes; and a plurality of electron emission particles having a work function lower than a work function of the carbon nanotubes, wherein at least portions of the plurality of electron emission particles are substantially uniformly dispersed within the twisted wire.

2. The thermal electron emitter as claimed in claim 1, wherein at least a portion of the plurality of electron emission particles are dispersed on a surface of the twisted wire.

3. The thermal electron emitter as claimed in claim 1, wherein the at least portions of the electron emission particles are dispersed on surfaces of the carbon nanotubes.

4. The thermal electron emitter as claimed in claim 1, wherein mass ratio of the electron emission particles to the twisted wire is in a range of about 50% to about 90%.

5. The thermal electron emitter as claimed in claim 1, wherein the carbon nanotubes are entangled with each other, and adjacent carbon nanotubes are joined by van der Waals attractive force.

6. The thermal electron emitter as claimed in claim 1, wherein each of the carbon nanotubes is selected from the group consisting of single-walled carbon nanotubes, double-walled carbon nanotubes, multi-walled carbon nanotubes, and combinations thereof.

7. The thermal electron emitter as claimed in claim 1, wherein diameters of the carbon nanotubes range from about 0.5nm to about 50nm.

8. The thermal electron emitter as claimed in claim 1, wherein lengths of the carbon nanotubes range from about 200 μm to about 900μm.

9. The thermal electron emitter as claimed in claim 1, wherein a diameter of the twisted wire ranges from about 20 μm to about 1 mm.

10. The thermal electron emitter as claimed in claim 1, wherein the electron emission particles comprise a material selected from the group consisting of alkaline earth metal oxide, alkaline earth metal boride, and a mixtures thereof.

11. The thermal electron emitter as claimed in claim 10 wherein the electron emission particles comprise alkaline earth metal oxide, and the alkaline earth metal oxide is selected from the group consisting of barium oxide, calcium oxide, strontium oxide, and a mixtures thereof.

12. The thermal electron emitter as claimed in claim 10, wherein the electron emission particles comprise alkaline earth metal boride, and the alkaline earth metal boride is selected from the group consisting of thorium boride, yttrium boride, and a mixture thereof.

13. The thermal electron emitter as claimed in claim 1, wherein diameters of the electron emission particles range from about 10 nm to about 100 μm.

14. The thermal electron emitter as claimed in claim 1, wherein two or more individual twisted wires are twisted together.

15. The thermal electron emitter as claimed in claim 1, further comprising at least one conductive wire twisted together with the at least one twisted wire.

16. The thermionic electron emitter as claimed in claim 15, wherein the at least one conductive wire comprises a material selected from the group consisting of gold, silver, copper and graphite.

17. The thermal electron emitter as claimed in claim 1, wherein the electron emission particles are capable of emitting electrons when heated to around 800° C.

18. A thermal electron emission device comprising:

a twisted wire comprising a plurality of carbon nanotubes;

a plurality of electron emission particles having a work function lower than a work function of the carbon nanotubes, wherein at least portions of the plurality of electron emission particles are substantially uniformly dispersed within the twisted wire; and a first electrode and a second electrode, and the twisted wire is electrically connected to the first electrode and the second electrode.

19. The thermal electron emission device as claimed in claim 18, wherein the first electrode and the second electrode comprise a metal or an alloy.

* * * * *